United States Patent [19]

Walker

[11] 4,064,058

[45] Dec. 20, 1977

[54] MIXED SYNTHETIC ESTER GREASE BASE STOCK

[75] Inventor: John F. Walker, Wilmington, Del.

[73] Assignee: Hercules Incorporated, Wilmington, Del.

[21] Appl. No.: 382,785

[22] Filed: July 26, 1973

Related U.S. Application Data

[63] Continuation-in-part of Ser. No. 230,997, March 1, 1972, abandoned, which is a continuation-in-part of Ser. No. 89,012, Nov. 12, 1970, abandoned.

[51] Int. Cl.[2] ..... C10M 1/24

[52] U.S. Cl. ..... 252/56 S

[58] Field of Search ..... 252/56 S

[56] References Cited

U.S. PATENT DOCUMENTS

| | | | |
|---|---|---|---|
| 2,448,567 | 9/1948 | Zisman | 252/56 S X |
| 2,782,166 | 2/1957 | Kolfenbach et al. | 252/56 S X |
| 3,278,586 | 10/1966 | Ovist | 252/56 S X |
| 3,360,465 | 12/1967 | Warman | 252/56 S X |
| 3,505,230 | 4/1970 | Thompson | 252/56 S X |
| 3,562,300 | 2/1971 | Chao et al. | 252/56 S X |

*Primary Examiner*—Delbert E. Gantz
*Assistant Examiner*—Andrew H. Metz
*Attorney, Agent, or Firm*—George H. Hopkins

[57] ABSTRACT

Disclosed is a grease base stock characterized by outstanding thermal and oxidation stability, low volatility, and high viscosity index. It comprises a blend of (1) a normally liquid pentaerythritol ester product consisting essentially of pentaerythritol material selected from the group consisting of pentaerythritol and polypentaerythritols, completely esterified by $C_4$–$C_{12}$ alkanoic acid material, and (2) a neopentyl glycol ester product having a substantially higher 77° F. viscosity than the pentaerythritol ester product and consisting essentially of the reaction product of neopentyl glycol, $C_4$–$C_{12}$ alkanedioic acid material and $C_4$–$C_{12}$ alkanol material substantially at mole ratios of $n$:($n$+1):2, $n$ being a whole number in the range from 1 to 12. The weight ratio of the pentaerythritol ester product to the neopentyl glycol ester product is generally in a range from about 2:3 to about 9:1.

11 Claims, No Drawings

MIXED SYNTHETIC ESTER GREASE BASE STOCK

The application is a continuation-in-part of the copending application Ser. No. 230,997, filed Mar. 1, 1972, as a continuation-in-part of the then copending application Ser. No. 89,012, filed Nov. 12, 1970, both of which are now abandoned.

This invention is in the chemical arts. It relates to the lubricant art and particularly to grease.

In summary, this invention comprises a grease base stock composed of a blend of (1) a normally liquid pentaerythritol ester product and (2) a neopentyl glycol ester product characterized by a substantially higher 77° F. viscosity than the pentaerythritol ester product. The terminology "a normally liquid pentaerythritol ester product" as used in this specification refers to a pentaerythritol ester product which is flowable or liquid at 77° F.

The normally liquid pentaerythritol ester product consists essentially of pentaerythritol material selected from the group consisting of pentaerythritol and polypentaerythritols, completely esterified by $C_4$–$C_{12}$ alkanoic acid material.

The pentaerythritol material in some embodiments of this invention comprises only one member of the group consisting of pentaerythritol and polypentaerythritols, while in other embodiments it comprises two or more such members. Examples of polypentaerythritols include dipentaerythritol, tripentaerythritol, tetrapentaerythritol, and the like, with the di-, tri- and tetrapentaerythritols being preferred.

$C_4$–$C_{12}$ Alkanoic acid material is material consisting essentially of at least one straight or branched chain alkanoic acid having 4–12 carbon atoms. In some embodiments of this invention alkanoic acid material comprises only one such acid. In other embodiments of this invention the acid material comprises two or more $C_4$–$C_{12}$ alkanoic acids. In preferred embodiments of this invention the acid material comprises one or more $C_6$–$C_8$ alkanoic acids. Examples of $C_4$–$C_{12}$ alkanoic acids include:

butyric acid
isobutyric acid
valeric acid
isovaleric acid
α-methylbutyric acid
pivalic acid
caproic acid
enanthic acid
caprylic acid
pelargonic acid
capric acid and the like.

Specific embodiments of the normally liquid pentaerythritol ester product are commercially available or can be made by processes well known to the art.

The neopentyl glycol ester product, specific embodiments of which at 77° F. range from a flowable or liquid state to a wax-like consistency, consists essentially of the reaction product of neopentyl glycol, $C_4$–$C_{12}$ alkanedioic acid material and $C_4$–$C_{12}$ alkanol material substantially at mole ratios of $n:(n+1):2$, $n$ being a whole number in a range from 1 to 12.

$C_4$–$C_{12}$ Alkanedioic acid material is material consisting essentially of at least one straight or branched chain alkanedioic acid having 4–12 carbon atoms. In some embodiments of this invention the alkanedioic acid material is composed of only one such acid. In other embodiments of this invention it comprises two or more $C_4$–$C_{12}$ alkanedioic acids. Examples of such acids include:

succinic acid
glutaric acid
adipic acid
pimelic acid
suberic acid
azelaic acid $C_4$–$C_{12}$ Alkanol material is material consisting essentially of at least one straight or branched chain alkanol having 4–12 carbon atoms. In some embodiments of this invention the alkanol material is composed of only one such alkanol. In other embodiments of this invention it comprises two or more $C_4$–$C_{12}$ alkanols. Examples of such alkanols include:

n-butanol
sec. butanol
t-butanol
n-pentanol
2-methylbutanol
n-hexanol
2,4-dimethylbutanol
n-heptanol
n-octanol
2-ethylhexanol
n-nonanol
n-decanol
n-dodecanol and the like.

The weight ratio of the pentaerythritol ester product to the neopentyl glycol ester product is generally in a range from about 2:3 to about 9:1. In general, within this range as the weight ratio of pentaerythritol ester product to the neopentyl glycol ester product is increased the viscosities of the grease base stock at temperatures from 0° to 210° F. are decreased.

The grease base stock of this invention is made by admixing the normally liquid pentaerythritol ester product and the neopentyl glycol ester product until an intimate blend is formed. While this is normally done at 77° F., such can be done also at higher and lower temperatures, with higher temperatures being preferred to lower temperatures because of the ease of admixing.

The grease base stock can be used as is or with one or more additives. Thus, one or more alkali metal salts of higher fatty acids, for example, lithium stearate at 10 or more percent by weight of the grease base stock, can be added to thicken the grease and give a stable, water-resistant dispersion. Polybutene at 1% by weight of the grease base stock or an isoalkyl methacrylate polymer at 0.1–5% by weight of the grease base stock can be added to give body and smooth appearance to the grease. Sorbitan monooleate can be added to inhibit rusting of lubricated parts. Various antioxidants and thermal stabilizers, for example, 4,4'-dioctyl diphenyl amine at 0.75% by weight of the grease base stock, and phenyl-β-naphthyl amine at 0.75% by weight of the grease base stock, can be added to further enhance the thermal and oxidative stability of the grease base stock.

The grease base stock either alone or with additives is used by applying it to surfaces to be greased. Generally, such surfaces are relatively movable with one surface being on the other.

The best mode now contemplated for carrying out this invention is illustrated by the following examples of various aspects of the invention, including specific embodiments. This invention is not limited to these specific embodiments. In these examples, unless otherwise indicated, all percentages are by weight.

EXAMPLES 1-5

These examples illustrate specific embodiments of the grease base stock of this invention, which embodiments are based on a normally liquid pentaerythritol ester product and a neopentyl glycol ester product, which products have the following characteristics.

The normally liquid pentaerythritol ester product consists essentially of technical pentaerythritol (monopentaerythritol is about 88-90%, dipentaerythritol is about 10-12%) fully esterified by alkanoic acid material consisting essentially of valeric acid (25%), caproic acid (15%), enanthic acid (31%), caprylic acid (9%) and pelargonic acid (20%), with the average carbon atom content of the alkanoic acid material being about 6.6. The 77° F. viscosity of this product is typically about 50 centistokes.

The neopentyl glycol ester product consists essentially of the reaction product of neopentyl glycol, azelaic acid and 2-ethylhexanol at a mole ratio of 6:7:2. The 77° F. viscosity of this product is typically about 3,000 centistokes.

The composition of the blend of each example as well as typical properties of each blend are set forth in Table I.

TABLE I

| Ex. No. | Blend Composition: Pentaerythritol Ester Product Parts By Weight | Blend Composition: Neopentyl Glycol Ester Product Parts By Weight | Viscosity (Centistokes) 77° F. | Viscosity (Centistokes) 100° F. | Viscosity (Centistokes) 210° F. | Viscosity Index |
|---|---|---|---|---|---|---|
| 1 | 87 | 13 | 70 | 41 | 82 | 170 |
| 2 | 81 | 19 | 100 | 60 | 10 | 170 |
| 3 | 72 | 28 | 190 | 100 | 14 | 170 |
| 4 | 60 | 40 | 260 | 140 | 17 | 170 |
| 5 | 50 | 50 | 400 | 190 | 22 | 170 |

In each example the blend is made by admixing at 77° F. the indicated quantities of the pentaerythritol ester product and the neopentyl glycol ester product until an intimate blend is formed.

EXAMPLES 6-10

These examples illustrate specific embodiments of a grease base stock of this invention based on another normally liquid pentaerythritol ester product and on the neopentyl glycol ester product of Examples 1-5.

The normally liquid pentaerythritol ester product of these examples consists essentially of technical pentaerythritol (monopentaerythritol is 88-98%, dipentaerythritol is 10-12%) fully esterified by alkanoic acid material consisting essentially of caprylic and capric acids with the average carbon atom content of the alkanoic acid material being about 8.4. The 77° F. viscosity of this pentaerythritol ester product is about 60 centistokes.

The composition of the blend of each example and typical properties of each blend are in Table II.

TABLE II

| Ex. No. | Blend Composition: Pentaerythritol Ester Product Parts By Weight | Blend Composition: Neopentyl Glycol Ester Product Parts By Weight | Viscosity (Centistokes) 77° F. | Viscosity (Centistokes) 100° F | Viscosity (Centistokes) 210° F. | Viscosity Index |
|---|---|---|---|---|---|---|
| 6 | 70 | 30 | 200 | 114 | 17 | 135 |
| 7 | 65 | 35 | 250 | 141 | 19 | 135 |
| 8 | 60 | 40 | 310 | 172 | 23 | 135 |
| 9 | 55 | 45 | 390 | 210 | 27 | 135 |
| 10 | 50 | 50 | 440 | 235 | 27 | 135 |

The blend of each of these examples is made by admixing at 77° F. the indicated quantities of the normally liquid pentaerythritol ester product and the neopentyl glycol ester product until an intimate blend is formed.

EXAMPLES 11-15

These examples illustrate specific embodiments of a grease base stock of this invention, which are based on still another normally liquid pentaerythritol ester product and on the neopentyl glycol ester product of Examples 1-5.

The normally liquid pentaerythritol ester product of these examples consists essentially of technical dipentaerythritol (dipentaerythritol is 90-95%, monopentaerythritol is 5-10%) completely esterified by alkanoic acid material consisting essentially of valeric acid (25%), caproic acid (15%), enanthic acid (31%), caprylic acid (9%) and pelargonic acid (20%), with the average carbon atom content of the alkanoic acid material being about 6.6. The 77° F. viscosity of this product typically is about 120 centistokes.

The composition of the blend of each example as well as typical properties of each blend are presented in Table III.

TABLE III

| Ex. No. | Blend Composition: Pentaerythritol Ester Product Parts By Weight | Blend Composition: Neopentyl Glycol Ester Product Parts By Weight | Viscosity (Centistokes) 0° F. | Viscosity (Centistokes) 77° F. | Viscosity (Centistokes) 100° F. | Viscosity (Centistokes) 210° F. | Viscosity Index |
|---|---|---|---|---|---|---|---|
| 11 | 70 | 30 | 9700 | 330 | 180 | 23 | 130 |
| 12 | 65 | 35 | 12400 | 390 | 210 | 27 | 130 |
| 13 | 60 | 40 | 15600 | 470 | 250 | 29 | 130 |
| 14 | 55 | 45 | 19600 | 560 | 280 | 33 | 130 |
| 15 | 50 | 50 | 17400 | 660 | 330 | 37 | 130 |

The blend of each of these examples is made in the same way as the blends of Examples 1-5 and 6-10.

EXAMPLES 16-18

These examples illustrate specific embodiments of a grease base stock of this invention, which comprise yet another normally liquid pentaerythritol ester product, and the neopentyl glycol ester product of Examples 1-5.

The normally liquid pentaerythritol ester product of this example consists essentially of pentaerythritol material consisting essentially of monopentaerythritol, dipentaerythritol, tripentaerythritol and tetrapentaerythritol at weight ratios of about 35:38:19:8, fully esterified by alkanoic acid material described in connection with Examples 1-5. The 77° F. viscosity of this ester product typically is bout 150 centistokes.

The composition of the blend of each example as well as typical properties of each blend are given in Table IV.

TABLE IV

| Ex. No. | Blend Composition: Pentaerythritol Ester Product Parts By Weight | Blend Composition: Neopentyl Glycol Ester Product Parts By Weight | Viscosity (Centistokes) 77° F. | Viscosity (Centistokes) 100° F. | Viscosity (Centistokes) 210° F. | Viscosity Index |
|---|---|---|---|---|---|---|
| 16 | 90 | 10 | 200 | 110 | 15 | 160 |
| 17 | 85 | 15 | 240 | 130 | 17.5 | 160 |
| 18 | 80 | 20 | 320 | 170 | 20 | 160 |

Each blend of these examples is made in the same way as the blends of Examples 1-5.

As is evident from the typical data for each of the blends of Examples 1-18, each embodiment of the grease base stock of this invention is characterized by a relatively high viscosity index and by substantial viscosity at 210° F. These properties are important when the grease base stock is used at high temperatures and loads, and resistance to flow from the lubrication area and maintenance of the load bearing properties of the grease are necessary.

Each embodiment of the grease base stock of this invention is also characterized by outstanding thermal stability. For example, when a grease consisting of the blend of Example 6, 4,4'-dioctyl diphenyl amine (0.75% by weight) and phenyl-$\beta$-naphthyl amine (0.75% by weight) is heated in air at a temperature increase of 5° C. per minute, up to 300° C. there is no significant weight loss due to thermal degradation.

Another feature of advantage of the grease base stock of this invention is its low volatility. The high average molecular weight of the blend combined with the polarity of the ester groups gives the composition very low volatility. For instance, when the blend of Example 6 is heated in air at a rate of 5° C. per minute, no significant volatile loss occurs up to 250° C., and when the blend is heated at 400° F. for 6.5 hours in air during the ASTM D972056 evaporation test, the typical weight loss is only 0.8%.

Still another feature of advantage of the grease base stock of this invention is its outstanding corrosion and oxidation stability. For example, when the blend of Example 6 is subjected to the MIL-L-23699 B corrosion and oxidation stability test at 400° F. for 72 hours in the presence of steel, silver, aluminum, magnesium and copper, typically no pitting, etching, staining or corrosion is observed. Moreover, the 100° F. viscosity typically increases only 13% during this time and the acid number increases by 1. Also, generally there is practically no accumulation of sludge during the test. These results show the base stock resists deterioration when heated in the presence of oxygen and metals, and does not attack typical metals found in lubrication applications.

Consequently, this invention provides a highly desirable grease base stock especially for use in high temperature applications.

Other features, advantages and specific embodiments of this invention will become readily apparent to those exercising ordinary skill in the art after reading the foregoing disclosures. Such specific embodiments are within the scope of the claimed subject matter unless expressly indicated to the contrary by claim language. Moreover, while specific embodiments of this invention have been described in considerable detail, variations and modifications of them can be effected without departing from the spirit and scope of the invention as disclosed and claimed.

The term "consisting essentially of" as used in this specification excludes any unrecited substance at a concentration sufficient to substantially adversely affect the essential properties and characeristics of the composition of matter being defined, while permitting the presence of one or more unrecited substances at concentrations insufficient to substantially adversely affect said essential properties and characteristics.

I claim:

1. A composition of matter useful as grease base stock, which consists essentially of a blend of (1) a normally liquid pentaerythritol ester product and (2) a neopentyl glycol ester product, the weight ratio of said products being in a range from about 2:3 to about 9:1, said pentaerythritol ester product consisting essentially of pentaerythritol material fully esterified by $C_4$-$C_{12}$ alkanoic acid material, said neopentyl glycol ester product having a substantially higher 77° F. viscosity than said pentaerythritol ester product, and consisting essentially of the reaction product of neopentyl glycol, $C_4$-$C_{12}$ alkanedioic acid material, and $C_4$-$C_{12}$ alkanol material, the mole ratio of said glycol to said alkanedioic acid material to said alkanol material being substantially $n:(n+1):2$ with $n$ being a whole number in the range from 1 to 12.

2. A composition according to claim 1 in which the alkanedioic acid material consists essentially of azelaic acid, and the alkanol material consists essentially of 2-ethylhexanol.

3. A composition according to claim 2 in which said mole ratio is 6:7:2.

4. The composition according to claim 3 in which the alkanoic acid material consists essentially of caprylic and capric acids and has an average carbon atom content of about 8.4.

5. The composition according to claim 4 in which the pentaerythritol material consists essentially of technical pentaerythritol.

6. The composition according to claim 4 in which the alkanoic acid material consists essentially of normal $C_5$–$C_9$ alkanoic acids with an average carbon atom content of about 6.6.

7. The composition according to claim 6 in which the pentaerythritol material consists essentially of technical pentaerythritol.

8. The composition according to claim 6 in which the pentaerythritol material consists essentially of technical dipentaerythritol.

9. The composition according to claim 6, in which the pentaerythritol material consists essentially of monopentaerythritol, dipentaerythritol, tripentaerythritol and tetrapentaerythritol at weight ratios of about 35:38:19:8.

10. A process for making a grease base stock, which comprises blending (1) a normally liquid pentaerythritol ester product with (2) a neopentyl glycol ester product at a weight ratio of pentaerythritol ester product to said glycol ester product in a range from about 2:5 to about 9:1, said pentaerythritol ester product consisting essentially of pentaerythritol material fully esterified by $C_4$–$C_{12}$ alkanoic acid material, said neopentyl glycol ester product having a substantially higher 77° F. viscosity than said pentaerythritol ester product, and consisting essentially of the reaction product of neopentyl glycol, $C_4$–$C_{12}$ alkanedioic acid material and $C_4$–$C_{12}$ alkanol material, the mole ratio of said glycol to said alkanedioic material to said alkanol material being $n$:($n$+1):2, $n$ being a whole number in the range from 1 to 12.

11. A method of lubricating relatively movable surfaces, one of which bears on the other, which comprises applying to said surfaces a grease consisting essentially of a blend of (1) a normally liquid pentaerythritol ester product and (2) a neopentyl glycol ester product, the weight ratio of said products being in a range from about 2:3 to about 9:1, said pentaerythritol ester product consisting essentially of pentaerythritol material fully esterified by $C_4$–$C_{12}$ alkanoic acid material, said neopentyl glycol ester product having a substantially higher 77° F. viscosity than said pentaerythritol ester product, and consisting essentially of the reaction product of neopentyl glycol, $C_4$–$C_{12}$ alkanedioic acid material and $C_4$–$C_{12}$ alkanol material, the mole ratio of said glycol to said alkanedioic material to said alkanol material being $n$:($n$+1):2, $n$ being a whole number in the range from 1 to 12.

* * * * *